US005333739A

United States Patent [19]

Stelte

[11] Patent Number: 5,333,739

[45] Date of Patent: Aug. 2, 1994

[54] METHOD AND APPARATUS FOR SORTING BULK MATERIAL

[75] Inventor: Norbert Stelte, Uberlingen, Fed. Rep. of Germany

[73] Assignee: Bodenseewerk Gerätechnik GmbH, Bodensee, Fed. Rep. of Germany

[21] Appl. No.: 35,480

[22] Filed: Mar. 24, 1993

[30] Foreign Application Priority Data

Mar. 27, 1992 [DE] Fed. Rep. of Germany ..... 4210157

[51] Int. Cl.[5] ..... B07C 5/342

[52] U.S. Cl. ..... 209/582; 209/587

[58] Field of Search ..... 209/576, 577, 578, 579, 209/580, 581, 582, 639

[56] References Cited

U.S. PATENT DOCUMENTS

| | | | |
|---|---|---|---|
| 3,737,239 | 6/1973 | Adams et al. | 209/582 X |
| 4,132,314 | 1/1979 | von Beckmann et al. | 209/582 X |
| 4,476,982 | 10/1984 | Paddock et al. | 209/582 |
| 4,807,762 | 2/1989 | Illy et al. | 209/580 |
| 4,919,534 | 4/1990 | Reed | 209/582 X |
| 4,992,949 | 2/1991 | Arden | 209/582 X |
| 5,002,397 | 3/1991 | Ingrum et al. | 209/582 X |

FOREIGN PATENT DOCUMENTS

| | | | |
|---|---|---|---|
| 0010940 | 5/1980 | European Pat. Off. | 209/580 |
| 0328126 | 8/1989 | European Pat. Off. | 209/580 |
| 0342389 | 11/1989 | European Pat. Off. | 209/580 |
| 0426893A1 | 5/1991 | European Pat. Off. . | |
| 2722294 | 1/1977 | Fed. Rep. of Germany | 209/582 |
| 3039979 | 4/1982 | Fed. Rep. of Germany | 209/582 |
| 3445428C2 | 6/1986 | Fed. Rep. of Germany . | |
| 3731402A1 | 12/1988 | Fed. Rep. of Germany . | |
| 3914360 | 10/1990 | Fed. Rep. of Germany | 209/580 |

OTHER PUBLICATIONS

"Optoelektronischer Glasscherben-Sortierer" by Dr. Rudolf Germer in messen + prüfen/automatik, pp. 286 and 288, May 1983.

"Neuronale Netze" by Helge Ritter, Thomas Martinetz and Klaus Schulten, 2nd Edition, 1991, pp. 53-60, Aug. 1991.

*Primary Examiner*—D. Glenn Dayoan

*Attorney, Agent, or Firm*—Lowe, Price, LeBlanc & Becker

[57] ABSTRACT

A method and apparatus for sorting bulk material, such as scrap glass, which consists of individual glass parts. Glass scraps are serially fed into a chute and illuminated by a white light source. An optical detector comprising two optical sensors measures optical frequency transmittance data from individual glass scraps, at two frequencies. The two transmittance measurements are logarithmized and a quotient is formed to eliminate the transmittance effect due to glass thickness. The scraps are then classified by a classifier on the basis of the measuring data in accordance with empirically determined classification parameters. The parts are then sorted by a compressed air jet in accordance with the classification. The classification parameters are previously determined by providing a sample of the glass of one color. The measuring data of that sample is determined and optimal classification parameters are then determined on the basis of the measuring data in occurring in the sample.

9 Claims, 5 Drawing Sheets

METHOD AND APPARATUS FOR SORTING BULK MATERIAL

TECHNICAL FIELD

The invention relates to a method of sorting bulk material which consists of individual parts to be sorted, comprising the steps of (a) determining measuring data indicative of characteristics which are relevant for the classification of the individual parts of the bulk material, (b) classifying the parts on the basis of said measuring data in accordance with empirically determined classification parameters, and (c) sorting said parts in accordance with said classification.

Such methods are, for example, used for sorting scraps of waste glass according to color, such as geen, brown or white or even only "colored" and white, in the process of the recycling of waste glass. To this end the scraps of glass are serialized to provide consecutive, individual scraps and to permit individual examination of each scrap of glass. The spectral absorptions or transmissions of the individual scraps of glass are measured at two different wavelengths. Therefrom measuring data can be derived which permit conclusions as to the color of the scrap of glass. Classification is effected by means of these measuring data. Control signals are generated in accordance with this classification. These control signals energize effectors. The effectors cause sorting of the scraps of glass.

BACKGROUND ART

German patent 3,445,428 describes a glass sorting device wherein the scraps of glass fall through a chute. Thereby they fall through light barriers with one light source and a plurality of photoelectric detectors. The detectors are made sensitive to different wavelengths by means of filters . The signals of the detectors are integrated. Depending on the detector signals, effectors are energized. The effectors are strippers. The scraps of glass fall on a conveyor and are directed to different containers by the strippers.

European patent application 0,426,893 describes a method and a device for sorting scraps of glass, wherein the intensity of the light directed through the scraps of glass is measured at two different wavelengths. The difference of the intensities of the light transmitted at the two wavelengths serve as measuring data for characterizing the glass. A fraction of the scraps of glass is separated, with which the difference is smaller than a first theshold and the intensities are larger than a second threshold. Such scraps of glass are regarded as colorless or "white" glass. The thresholds represent classification parameters. A compressed air stream serves as effector.

Flaps serve as effectors in the German patent application 3,731,402. The colors of the scraps of glass are differentiated by means of light barriers with color filters.

A paper by Germer "Optoelektronischer Glasscherben-Sortierer" in "messen+prüfen / automatik" (1983), 286–288 describes a sorting device, wherein the transmission is measured at two wavelengths in the green and red spectral ranges. The quotients of the transmissions serve as measuring data for characterizing the type of the glass.

In all these cases, classification parameters have to be fixed. The fixing of these classification parameters presents certain problems.

The fractions obtained by the sorting are the more valuable the clearer the various colors of the glass are separated. This is particularly true for colorless glass, where even small proportions of colored glass considerably reduce the value of the waste glass. Therefore the setting of the classification parameters is very critical.

On the other hand, the measuring data such as the quotient of the transmissions at two different wavelengths is, by no means uniform for a fraction of scraps of glass, for example of green glass. Within the fraction, the measuring data may ray between more or less wide limits. Furthermore, the measuring data may depend on other influences, for example on the contamination level, the ambient temperature or atmospheric humidity (moisture, frozen moisture or fogging of scraps of glass). Therefore the setting of the classification parameters is not simple.

DISCLOSURE OF THE INVENTION

It is an object of the invention to find optimal classification parameters for the sorting of bulk material such as scrap glass.

A further object of the invention is to design a device for the sorting of bulk material such that adjustment of the classification parameters, for example thresholds of measuring data, to optimal values is effected automatically.

The method of the invention is characterized in that said classification parameters are determined by providing at least one fraction of said bulk material, the parts of said fraction being associated with one class of said classification, determining the measuring data of this fraction, and determining optimal classification parameters on the basis of said measuring data occurring in said fraction.

A device for sorting bulk material which consists of individual parts to be sorted comprising:

(a) feeding means for feeding said bulk material, (b) serializing means for serializing said bulk material to provide consecutive, individual parts to be sorted, (c) sensor means for measuring characteristics relevant for the classification of the parts to be sorted and for generating measuring data indicative of said characteristics, (d) computer means for classifying said parts to be sorted on the basis of said measuring data in accordance with adjustable classification parameters and for generating control signals depending on said classification, and (e) effector means, which are controlled by said control signals, for sorting said parts, is, according to the invention, characterized by (f) means for determining values of said classification parameters from measuring data of fractions of the bulk material supplied to said sorting device, and (g) means for automatically setting said classification parameters to the values thus determined.

According to the invention, there is a "learning phase", during which the classification parameters are determined and set, and a "sorting phase", during which the bulk material is sorted in accordance with the set classification parameters.

The setting of the classification parameters during the learning phase is effected as follows:

It is assumed that the bulk material to be sorted contains only parts which are associated either with a class A or with a class B. N different measuring data are determined for each part. These measuring data may, for example, be the light intensities in N different spectral ranges. "Measuring data" may also be data derived from primary data, such as the quotient or difference of intensities obtained in different spectral ranges. Such derived data serve to reduce the number of the data to be processed.

N different data can be represented by a point in a N-dimensional parameter space. If multiple data of a part or of different parts of the same class are measured, the points will, in general, not coincide due to the unavoidable measuring errors and other influences but form a distribution ("cloud of points") in the N-dimensional parameter space.

At first, in a learning phase, only measuring data for parts of class A are measured by supplying only parts of class A as a uniform fraction to the sensors of the sorting device. This results in the cloud of points of class A in the N-dimensional parameter space.

The same procedure is applied to class B, whereby also the cloud of points of this class is obtained in the same parameter space. In the N-dimensional parameter space, the clouds of points pertaining to the different classes A and B will, in general, occupy regions which partly overlap.

The next step is to determin classification parameters which define, in the parameter space, a (N−1)-dimensional surface, which separates the whole parameter space into a region A and a region B. This surface is to be placed such that as many points of class A as possible are located in the region A and as many points of class B as possible are located in the region B. When the clouds of points overlap, there will be an optimization problem. An optimization criterion in the form of a cost function has to be selected for this optimization problem.

Each of the separated regions A and B can be coherent. However this is not necessarily so.

For example, in a two-dimensional parameter space, i.e. an area, the one-dimensional "surface" is a line which separates the area in the regions A and B. The line may be open or may also be closed to form, for example, a circle. In the latter case, region A is inside the circle and region B is outside the circle.

In a one-dimensional parameter space (line), the zero-dimensional "surface" comprises one or more points, which divide the line into sections, each of the section being associated with one of the areas A or B.

The optimization criterion is minimization of a cost function $k=f(x,y)$, for example $k=a*x+b*y$, x being the proportion of the points A which lie in the region B (and therefore being mis-sorted), and y being the proportion of the points B which lie in the region A (and therefore also being mis-sorted). The coefficients a and b result from economic considerations. When sorting scraps of glass according to their colors, such economic considerations involve the actual value of the colorless glass being free from faulty colors (parameter a) and the loss of colorless glass by mis-sorting it into the colored fraction.

A large number of methods of solution of such optimization problems are known from the literature. A simple method operates as follows: The N-dimensional parameter space is subdivided into N-dimensional cells, the size of the cells being an empiric parameter. In the two-dimensional case, this is a checkered subdivision. Now the cell is looked for in which the ratio of the number of points from class A to the number of points from class B is a maximum. This cell is defined as region A. The remaining parameter space is defined to be region B. With the aid of a random generator, the region A is enlarged stepwise by a respective one of the six possible adjacent cells at the expense of region B. After each change of regions, the cost function is computed. Those changes of region which cause a decrease of the cost function are retained. If, however, the cost function is increased by a particular change of region, this change of region is cancelled. If also reductions of regions and the occupation of non-adjacent regions are included in this procedure, the global or overall minimum of the cost function can be detected in addition to local minima.

At the end of the procedure, after the cost function has become convergent, a parameter space subdivided into the regions A and B is obtained. There is a set of classification parameters which either directly define the regions A or B (for example as the sum of the coordinates of the cells pertaining to region A), or define the (N−1)-dimensional limiting surface between the regions A and B. There may be approximations which reduce the number of classification parameters.

In the sorting phase, a part to be sorted is associated with class A, if the measuring data point in the N-dimensional parameter space is located in the region A. A part to be sorted is associated with class B, if the measuring data point in the N-dimensional parameter space is located in the region B.

Though the procedure described requires considerable calculating time, the procedure has, in general, to be carried out for the first setting of the classification parameters. For subsequent optimizations, it is possible to start from the global minimum once found.

The calculating procedure can be sped up by methods described in literature such as evolution strategies or genetic algorithms. In particular, if empiric or theoretic knowledge about the distribution of the clouds of points is available, a formulation for the description of the separating surface between the regions A and B can be selected which is defined by a set of classification parameters. In this case, the cost function will be varied by statistical variation of the classification parameters, until the global minimum has been reached.

A similar procedure is used, if more than two classes are to be separated.

Another possibility is that said computer means comprise a neural network arranged to receive, consecutively, measuring data from a fraction of known composition, the weights of said neural network being varied during a training process in accordance with an algorithm of the neural network such as to associate, with the required probability, said measuring data of said fraction of known composition with said fraction.

The use of a "learning" signal processing unit for the classification and sorting offers the advantage that the physical relations between measuring data and class of the part to be sorted need not be known for the determination of the classification parameters. This may become important, when contaminated scraps of glass are to be sorted. In this case, such relations may be unknown and not easily derived.

Further modifications of the invention are subject matter of the dependent claims.

BRIEF DESCRIPTION OF DRAWINGS

An embodiment of the invention is described hereinbelow with reference to the accompanying drawings.

BEST MODE FOR CARRYING OUT THE INVENTION

Figure 1:
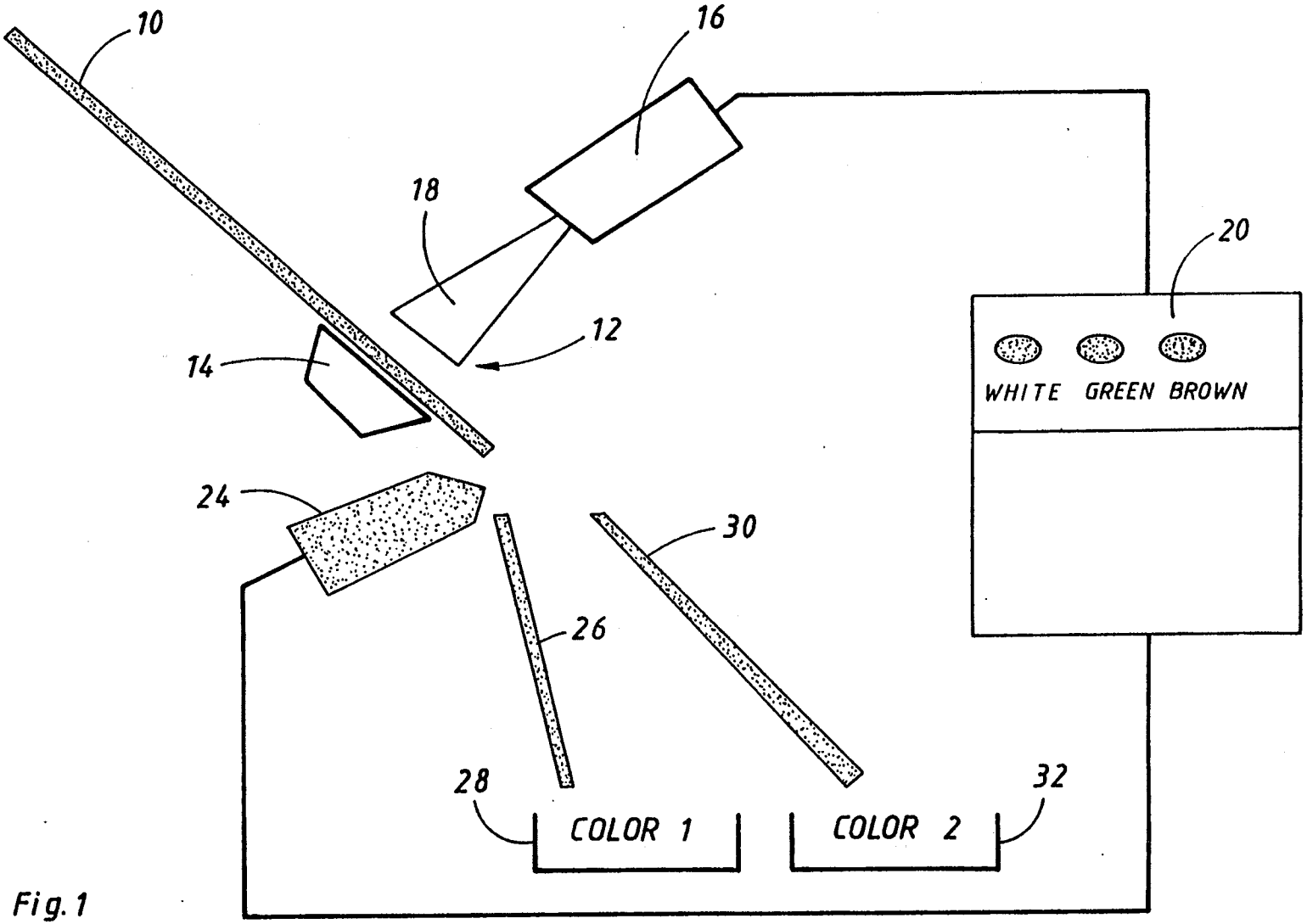
FIG. 1 is a schematic illustration of a device for sorting scraps of waste glass of different colors.

Referring to FIG. 1, numeral 10 designates a chute to which waste glass in the form of scraps of glass can be supplied. The chute is designed such that the scraps of glass are serialized. Therefore, the scraps of glass pass by a measuring station 12 individually. The measuring station comprises an illumination device 14 on one side of the chute, which is transparent at this location. The illuminating device or light source assembly directs white light through the scraps of glass passing by. The light is received by a sensor head 16. Numeral 18 designates a lens protection for protecting the lenses contained in the sensor head 16. The signals received from the sensor head 16 are applied to a computer and control unit 20. The computer and control unit 20, at an output 22 thereof, provides signals for energizing an effector 24. The effector 24 is a compressed air nozzle which causes the scraps of glass falling down from the chute, either to be directed to a first container 28 through a distributor chute 26, if no compressed air is supplied to the nozzle, or to be directed to a second container 32, if compressed air is supplied to the nozzle. Of course, also distribution into three containers can be achieved in similar way.

Figure 2:
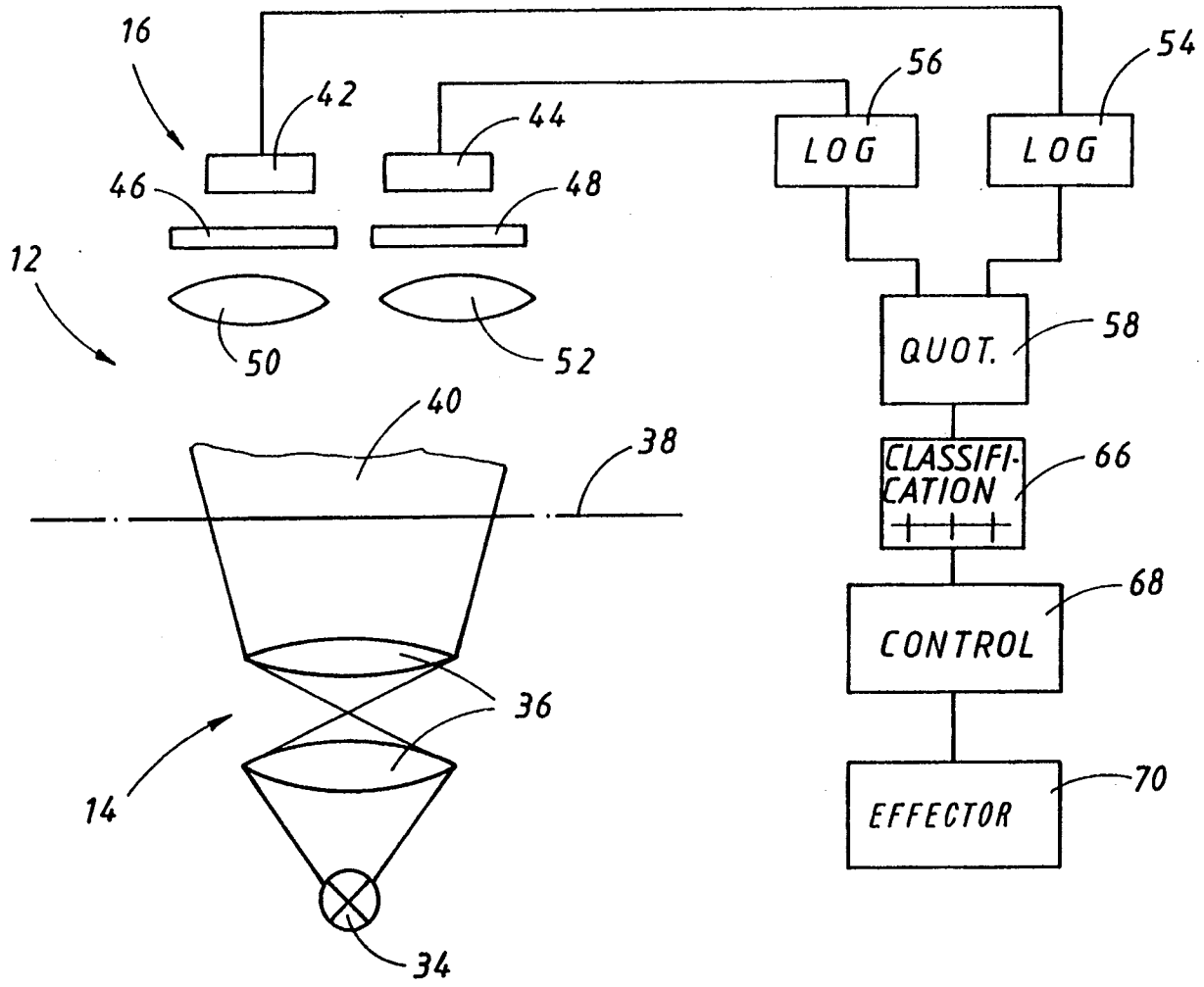
FIG. 2 is a schematic illustration of the sensor assembly and of the signal processing in a device of FIG. 1.

FIG. 2 schematically shows the measuring station 12. The illuminating device 14 contains a white light source 34. The light beam from the light source 34 is directed by an optical system 36 through the scraps 40 of glass passing by along a path 38.

The light is received by the sensor head 16. The sensor head 16 contains two photoelectric sensors 42 and 44. Filters 46 and 48 are arranged in front of the sensors 42 and 44, respectively. The light from the illuminating device 14 is focused by optical systems 50 or 52 on the respective sensor 42 or 44, respectively.

The sensors 42 and 44 provide signals which are proportional to the transmission of the respective type of glass of the scrap 40 at the wavelengths determined by the filters 46 and 48, respectively. After scaling (not shown), the signals of the sensors 42 and 44 are logarithmized by logarithmizing means 54 and 56, respectively. This provides the transmittance of the glass at the different wavelengths, in each case multiplied by the thickness of the glass. By forming the quotient, as illustrated by block 58, the thickness of the glass is eliminated, as the light of both wavelengths has to pass through the same thickness of glass.

Figure 3:
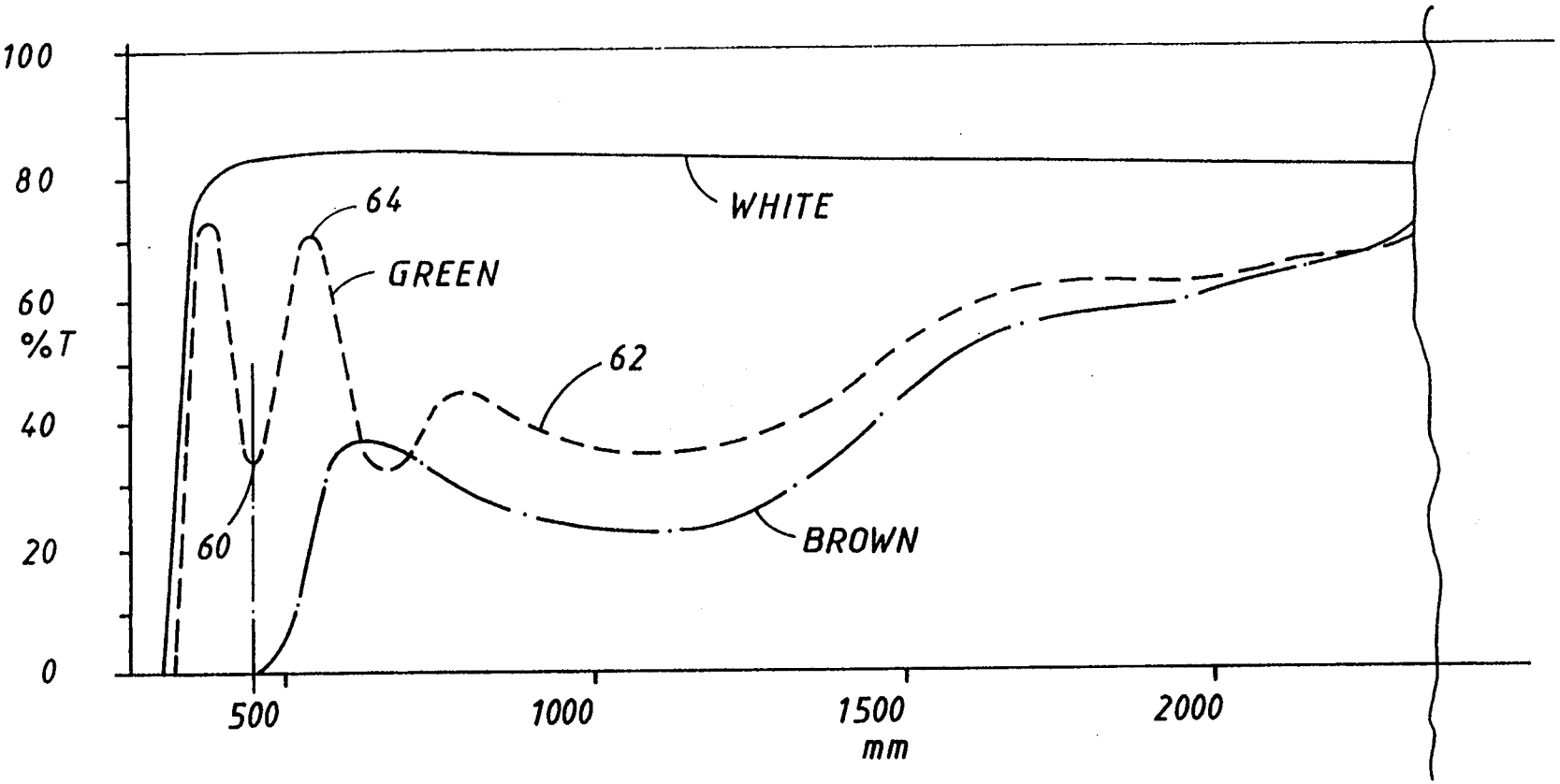
FIG. 3 illustrates the transmissions of different kinds of glass as functions of wavelength.

The quotients obtained are measuring data which are characteristic of the color of the glass. This can be seen from FIG. 3. FIG. 3 shows the transmission of different types of glass as a function of wavelength. It can be seen that the quotient of the transmittances at two different wavelengths is characteristic of the color of the glass, if the wavelengths are selected appropriately.

For better understanding, the situation will be explained hereinbelow with reference to the (non-logarithmized) transmission.

If, for example, a measurement is made at a wavelength near the minimum 60 of the transmission graph 62 for green glass and at a wavelength near the maximum 64 of this graph, the quotient for green glass provides a value near, 0.5. Brown glass yields, at these wavelengths, a value near zero, while the value for white glass is about one. If thresholds are defined between these values, and glass for which the quotient is slightly smaller than 0.25 is regarded as "brown" glass for which the quotient lies between 0.25 and 0.75 is regarded as "green", and glass for which the quotient lies above 0.75 regarded as "white", the glass can be sorted on the basis of these thresholds. The thresholds represent "classification parameters".

Actually, the logarithms of the transmission values, i.e. the transmittance values are computed, and the ratio of these transmittance values are used as a classification parameter defining a one-dimensional parameter space.

This sorting on the basis of the quotient of the transmittance is illustrated in FIG. 2 by block 66. A control signal is generated depending on the sorting. This is illustrated by block 68. The control signal energizes the effector 24. This is illustrated by block 70. The effector 24 directs the respective scrap of glass into the container corresponding to its color.

It is obvious that the transmission graphs of, for example, green scraps of glass will not all be identical with graph 62 of FIG. 3. "Green" glass may have different shades of color and, correspondingly, also different transmission graphs. Also labels adhering to the scrap of glass or other contaminations may affect the transmission graph. Though the character of the transmission graph is substantially the same, there are deviations from the graph shown in FIG. 3. This has the result that also the quotients of the logarithms of transmissions measured at the two wavelengths can vary within a certain range. Therefore, the exact fixing of the thresholds for the classification present certain problems.

If mixed color scrap glass is to be separated, as shown in FIG. 1, into two glass fractions of which one fraction contains white glass (color 1) and the other fraction contains brown and green glass (color 2), the frequency distribution for white glass is associated with class "A" and the frequency distribution for brown and green glass is associated with class "B". The frequency distribution can be represented by clouds of points in a one-dimensional parameter space, the parameter being the quotient of the logarithms of the intensities at two specific wavelengths.

If measurements are made with a fraction of glass of known type, such as for example of brown scraps of glass of typical composition, and the quotients ("measuring data") obtained therewith are classified in accordance with their value, this will provide a certain frequency distribution.

Figure 5:
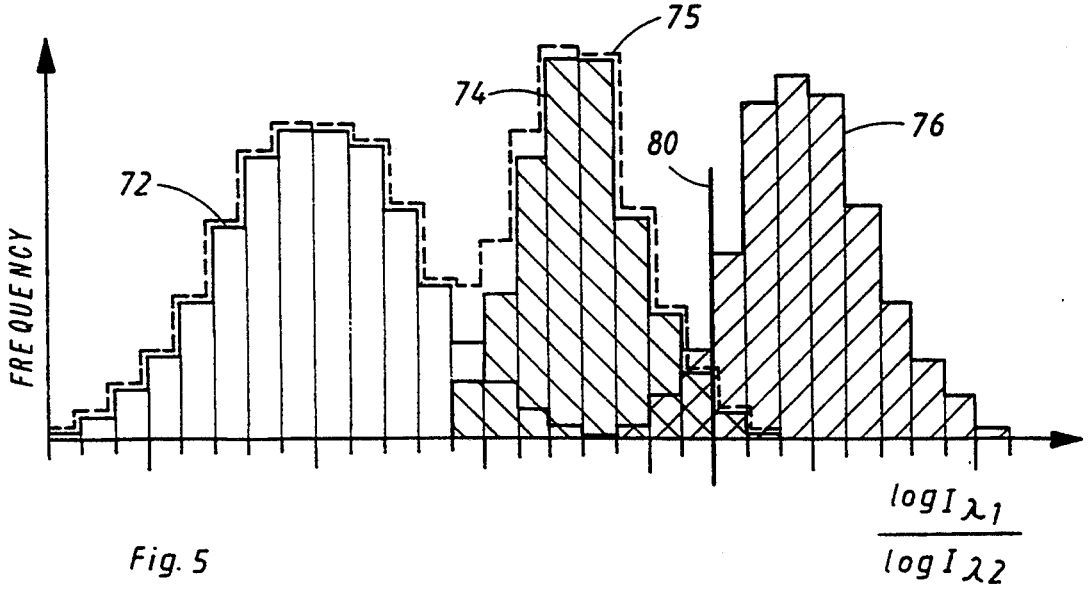
FIG. 5 shows, as an example, two frequency distributions for the measuring data in a device of FIGS. 1 and 2, if consecutively two uniform fractions of waste glass are supplied.

For better illustration of such a frequency distribution a "histogram" can be used, as shown in FIG. 5. To obtain such a histogram, a number of contiguous ranges of values of the quotient are defined. A fraction of scraps of glass of known color, such as brown, of typical composition is measured. The number of the scraps of glass the transmittance quotients of which fall within a particular range are counted and associated with this range. The result is a stepped function or histogram such as 72 in FIG. 5.

If subsequently the same measurements are made with typical fractions of green and white scraps of glass, this may result in histograms 74 and 76, respectively as shown in FIG. 5. The histograms 72, 74 and 76 of FIG. 5 are schematically shown as a kind of Gaussian distribution curves. The histograms may, however, have quite different shapes. If, for example, the green and brown fractions are combined to a "colored" fraction, this will provide something like histogram 75 for the combined, colored fraction.

The statistical frequency distributions of typical fractions are used to determine optimum classification parameters. In the present case, the classification parameters are thresholds in a one-dimensional parameter space.

As explained above, a preferable optimization criterion is minimization of a cost function $k=f(x,y)$, for example $k=a*x+b*y$, x being the proportion of the points A which lie in the region B (and therefore being mis-sorted), and y being the proportion of the points B which lie in the region A (and therefore also being mis-sorted). The coefficients a and b result from economic considerations. When sorting scraps of glass according to their colors, such economic considerations involve the actual value of the colorless glass being free from faulty colors (coefficient a) and the loss of colorless glass by mis-sorting it into the colored fraction (coefficient b).

This may result in a threshold such as 80 in FIG. 5.

Such a statistic evaluation permits the fixing of the classification parameters on a solid basis. The statistic evaluation permits, in particular, optimization in accordance with certain criteria. The fixing of the classification parameters is independent of the discretion and erroneous estimation on the part of the user.

Figure 4:
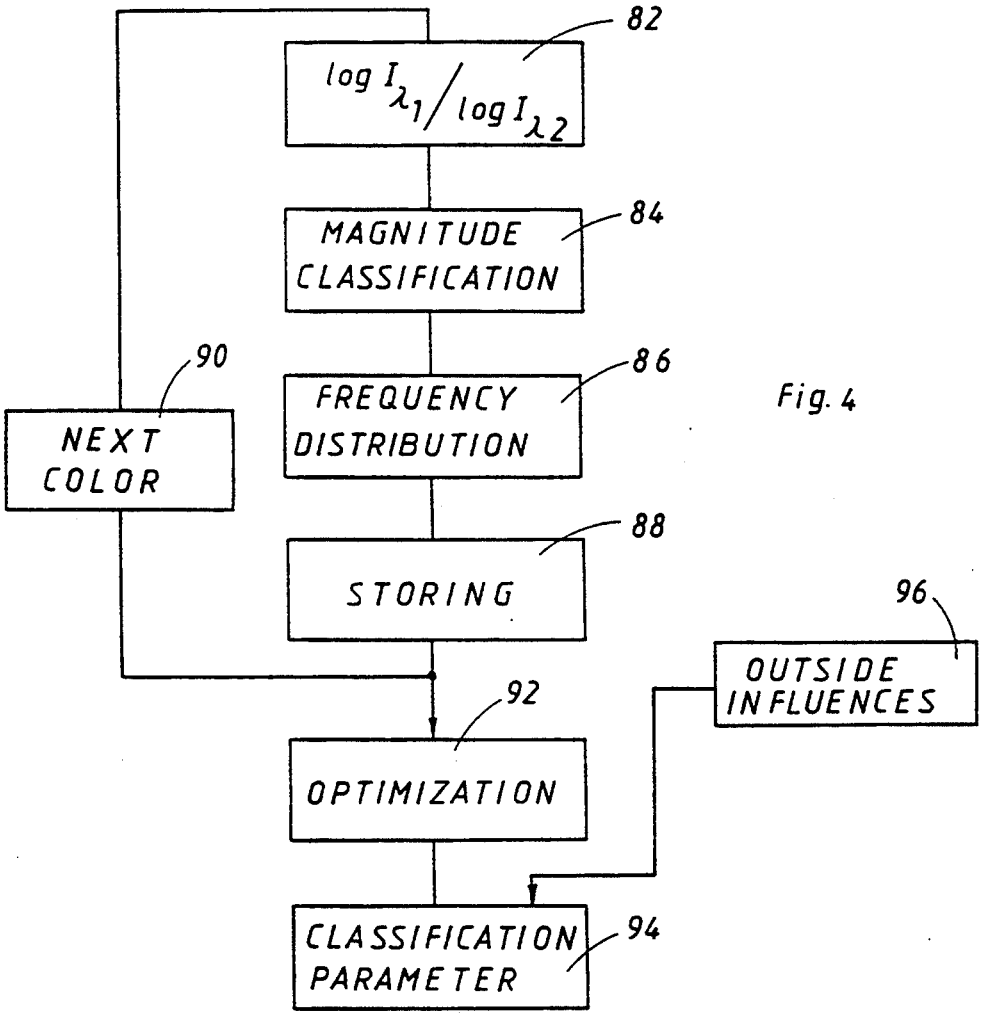
FIG. 4 is a diagram and illustrates the various steps of the signal processing for determining the optimal classification parameters.

The statistic evaluation can be used to adjust the classification parameters at the device for sorting of bulk material automatically. This is schematically illustrated in FIG. 4.

A first batch of, for example, brown glass is supplied to the device. The quotients of the logarithms of the intensities at two preselected wavelength are formed as measuring data. This is represented by block 82 in FIG. 4. The measuring data thus obtained are digitized and classified by a computer in accordance with their values. This classification is a fine classification of the measuring data and has still nothing to do with the classification of the glass types. This classification corresponds substantially to the abscissa in FIG. 5. The classification is illustrated by block 84 in FIG. 4. The computer adds up the number of measuring data of the same class and, thereby, provides a frequency distribution. This is similar to histogram 72 in FIG. 5. The formation of a frequency distribution is illustrated by block 86 in FIG. 4.

After the first frequency distribution has been stored, a batch of scraps of glass of the next color, thus, for example, of green scrap glass, is supplied to the device. This is symbolized by a loop 90. If all colors are measured in this way, thus if all three frequency distributions have been stored similar to FIG. 5, the thresholds or classification parameters are optimized by the computer. This is illustrated by block 92. In accordance with this optimization, the classification parameters are automatically set in the device. This is illustrated by block 94 in FIG. 4.

Still other influencing variables which could affect the measuring data are taken into consideration when automatically setting the classification parameters. Such influencing variables may be ambient temperature or atmospheric humidity. The influence of such influencing variables may be measured by measuring one and the same batch of scrap glass at different atmospheric humidities in the way described above. Then sets of classification parameters at different atmospheric humidities are available. During the normal sorting operation of the device, the atmospheric humidity will be measured continuously. The set of classification parameters can the be adjusted automatically. It is possible to simply use a parameter set associated with a humidity which is closest to the measured one. It is, however, also possible to calculate a set of classification parameters by interpolation. The same procedure is applicable to other influencing variables. The measuring of an influencing variable is represented by block 96.

Figure 6:
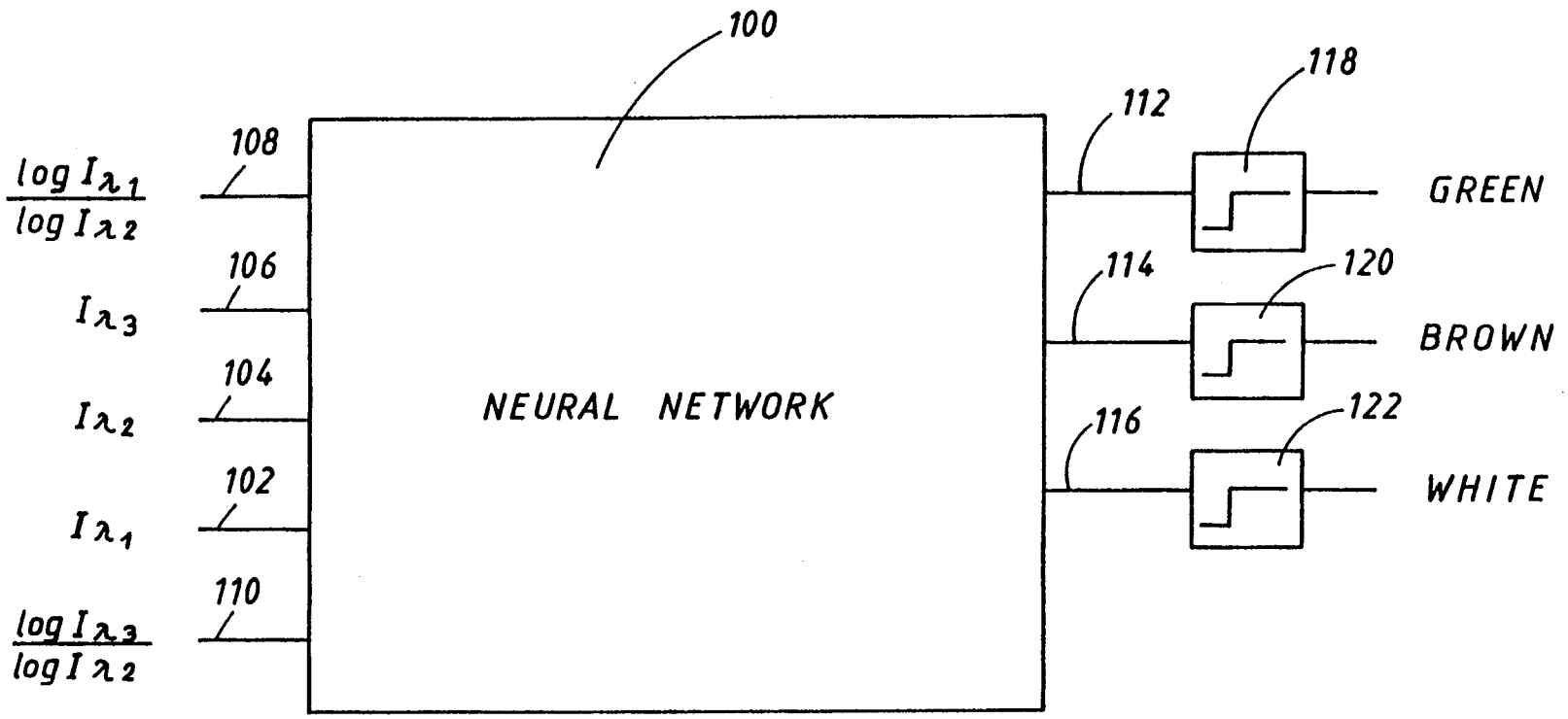
FIG. 6 shows a neural network as an example of a "self-learning" signal processing.

Instead of evaluating statistic frequency distributions of the measuring data, also a neural network can be used as "self learning" signal processing device. Such a neural network is illustrated in FIG. 6.

Numeral 100 designates a neural network which operates with the algorithm of "back propagation". In the present case, the neural network has five inputs 102, 104, 106, 108, and 110. The transmissions I at three different wavelengths and the ratios of the logarithms of the transmissions at the firs and second wavelengths and at the third and second wavelengths, respectively, are applied as measuring data to these inputs 102, 104, 106, 108, and 110, respectively. The neural network has three outputs 112, 114, and 116. Output 112 is associated with the glass color "green". Output 114 is associated with the glass color "brown". Output 116 is associated with the glass color "white". In a training process, again fractions of waste glass in the form of scraps of glass, for example, are measured. The measuring data of, for example, green glass are consecutively applied to the inputs 102 to 110. The output 112 is set to "high", i.e. logic one. The outputs 114 and 116 are set to "zero". By iteration steps according to a "back propagation" algorithm, the weights in the neural network are varied step-by-step such that a "high" or "logic one" at output 112 and "logic zero" at the outputs 114 and 115 is obtained by inputing "green" measuring data. Thus starting from the outputs 112, 114 and 116, the measuring data applied to the inputs 102 to 110 are optimally approximated by varying the weights. Therefore this algorithm is called "back propagation". This algorithm is well known to a person skilled in the art and, therefore, need not be described in detail (see, for example, Ritter, Martinetz and Schulten, "Neuronale Netze", 2nd edition 1991, pages 53 to 60). This training is repeated with a fraction of brown glass and with a fraction of white glass.

After the neural network has been trained, an output signal will predominantly appear at output 112, if measuring data of green glass are applied to the inputs. The signals at the outputs 114 and 116 will be considerably weaker. Correspondingly, an output signal will predominantly appear at output 114, if measuring data of brown glass are applied to the inputs, and an output signal will predominantly appear at output 116, if measuring data of white glass are applied to the inputs. The signals at the respective other outputs are considerably weaker. By selecting thresholds, represented by blocks 118, 120, 122, unambiguous classification statements of "green", "brown" or "white" can be obtained. Depending on these classification statements, the effectors will be energized to sort the scraps of glass into the respective containers.

In this case, "measuring data" are the quantities applied to the inputs 102 to 110. "Classification parameters" are the weights of the neural network which ensue from the training of the neural network.

I claim:

1. A device for sorting individual parts of bulk material, said device comprising:

feeding means for feeding said bulk material;

serializing means, coupled to said feeding means, for serializing said bulk material to provide consecutive, individual parts;

sensor means for measuring characteristics relevant for the classification of the parts and for generating measuring data indicative of said characteristics;

computer means, coupled to said sensor means, for classifying said parts on the basis of said measuring data in accordance with adjustable classification parameters and for generating control signals depending on said classification;

effector means, coupled to said computer means and controlled by said control signals, for sorting said parts;

means for determining values of said classification parameters from measuring data of fractions of the bulk material supplied to said sorting device; and means for automatically setting the classification parameters to the values thus determined.

2. A device as claimed in claim 1, wherein said means for determining values of said classification parameters comprise:

(a) means for classifying said measuring data, and (b) means for determining and storing the frequency distribution of the measuring data thus classified.

3. A device as claimed in claim 2, wherein said means for determining said classification parameters comprise means for determining optimal classification parameters from stored frequency distributions of different fractions from said bulk material.

4. A device as claimed in claim 3, further comprising means for varying said classification parameters in response to additional measuring data.

5. A device as claimed in claim 1, wherein said computer means comprise a neural network arranged to receive, consecutively, measuring data from a fraction of known composition, the weights of said neural network being varied during a training process in accordance with an algorithm of the neural network such as to associate, with the required probability, said measuring data of said fraction of known composition with said fraction.

6. A method of sorting scraps of waste glass in accordance with color, comprising the steps of:

preparing a first fraction of scraps of waste glass of a first color, said first fraction being typical of the waste glass to be sorted, measuring spectral transmissions of each scrap of said first fraction at least two wavelengths and determining a function of the measured spectral transmissions as a measuring quantity, preparing a second fraction of scraps of waste glass of a second color, said second fraction also being typical of the waste glass to be sorted, measuring spectral transmissions of each scrap of said second fraction at least two wavelengths and determining a function of the measured spectral transmissions as a measuring quantity, determining from the values of said measuring quantity occurring with said fractions classification parameters for associating scraps with colors optimized with respect to predetermined criteria, classifying unknown scraps and associated such scraps to said first or second colors in accordance with the values of said measured quantity with said classification parameters derived from said typical fractions, and sorting said scraps in accordance with said classification.

7. A method as claimed in claim 6, wherein said function of said spectral transmissions representing said measured quantity is the ratio of the logarithms of the spectral transmissions at said two wavelengths, said classification parameters being limits of said measured quantity which define the classification of said scraps with respect to color.

8. A method as claimed in claim 7, wherein the frequency distribution of the values of said measured value in said fractions the scraps of waste glass are determined and stored, and are evaluated in accordance with said criteria to determine said limits.

9. A method as claimed in claim 6, wherein during a training process, values of measuring quantities of scraps taken from a fraction of scrap waste glass of a first color are consecutively supplied to a neural network, the weights of said neural network being varied in accordance with an algorithm of said neural network until the values of measuring quantities of scraps belonging to said fraction are associated, with a desired probability, to said first color, said weights representing classification parameters, and values of measuring quantities are determined of unknown scraps of scrap waste glass, said values being applied to said neural network, said neural network associating or not-associating said unknown scrap with said color.

* * * * *